US011571716B2

(12) United States Patent
Bourne et al.

(10) Patent No.: US 11,571,716 B2
(45) Date of Patent: Feb. 7, 2023

(54) PRODUCT APPLICATOR ASSEMBLY

(71) Applicant: Energizer Brands II, LLC, St. Louis, MO (US)

(72) Inventors: Christopher Bourne, Stansbury Park, UT (US); Aaron Irvin, Draper, UT (US); James Tracy, St. Louis, MO (US)

(73) Assignee: Energizer Group Limited, High Wycombe (GB)

( * ) Notice: Subject to any disclaimer, the term of this patent is extended or adjusted under 35 U.S.C. 154(b) by 0 days.

(21) Appl. No.: 17/085,281

(22) Filed: Oct. 30, 2020

(65) Prior Publication Data

US 2021/0046516 A1 Feb. 18, 2021

Related U.S. Application Data

(62) Division of application No. 15/961,268, filed on Apr. 24, 2018, now Pat. No. 10,857,569.

(60) Provisional application No. 62/568,460, filed on Oct. 5, 2017.

(51) Int. Cl.

| | |
|---|---|
| ***B05C 17/00*** | (2006.01) |
| ***B08B 1/00*** | (2006.01) |
| ***B08B 3/04*** | (2006.01) |
| ***B65D 47/42*** | (2006.01) |

(52) U.S. Cl.

CPC ..... *B08B 1/001* (2013.01); *B05C 17/00* (2013.01); *B08B 3/04* (2013.01); *B65D 47/42* (2013.01); *B08B 1/00* (2013.01)

(58) Field of Classification Search

None

See application file for complete search history.

(56) References Cited

U.S. PATENT DOCUMENTS

| | | | | |
|---|---|---|---|---|
| 4,498,796 | A * | 2/1985 | Gordon | A47K 7/03 604/3 |
| 6,595,940 | B1 * | 7/2003 | D'Alessio | A61P 1/02 604/3 |
| 6,726,386 | B1 | 4/2004 | Gruenbacher et al. | |
| 7,108,440 | B1 | 9/2006 | Gruenbacher et al. | |
| 2009/0142387 | A1 * | 6/2009 | Blackwell | G02B 1/043 424/78.37 |
| 2012/0284946 | A1 | 11/2012 | Green | |

OTHER PUBLICATIONS

White, Mike; "Finish Line Products No Drip Chain Luber Advertisement identified in Being There: Bike PressCamp 2014, Day One" at Bike Press Camp, Road Bike Action Magazine, Jul. 24, 2017, 9 pages, retrieved from <https://roadbikeaction.com/being-there-bike-presscamp-2014-day-one/>.

* cited by examiner

*Primary Examiner* — Eric W Golightly
(74) *Attorney, Agent, or Firm* — Lee & Hayes, P.C.

(57) ABSTRACT

A product applicator assembly includes a handle, an applicator, and a product dispensing assembly. The product dispensing assembly is disposed at least in part within the handle and stores a liquid product within a product container. A puncturing device within the product dispensing assembly has a base and a puncture element extending from the base toward the product container. The puncturing device further includes a mating member extending from the base and secured to the product container. The puncture element facilitates rupturing the product container to release a portion of the liquid product into the applicator.

20 Claims, 15 Drawing Sheets

PRODUCT APPLICATOR ASSEMBLY

CROSS-REFERENCE TO RELATED APPLICATIONS

This patent application is a division of U.S. patent application Ser. No. 15/961,268, filed Apr. 24, 2018, issued as U.S. Pat. No. 10,857,569 on Dec. 8, 2020, which claims priority to U.S. Provisional Patent Application Ser. No. 62/568,460, filed Oct. 5, 2017, all of which are hereby incorporated herein in their entirety.

TECHNICAL FIELD

Embodiments generally relate to a product applicator assembly and methods for using the product applicator assembly. An example embodiment provides a product applicator assembly configured to dispense and apply a cleaning solution or conditioner.

BACKGROUND

Commonly, cleaning solutions, such as household cleaning solutions, automotive cleaning solutions, and/or the like are provided to consumers in dispenser containers, such as spray bottles, squeeze bottles, pour bottles, open-top cans, and/or the like. The consumer may then spray or otherwise provide some of the cleaning solution onto a surface to be cleaned, and wipe the surface with a towel. While these sorts of dispenser containers may be designed to enable a consumer to easily monitor the amount of cleaning solution applied to a particular surface, consumers are forced to utilize other applicators, such as towels, sponges, and/or the like to distribute the cleaning solution across the surface to be cleaned. However, these common applicators may cause at least a portion of the cleaning solution to contact a consumer's hands during cleaning. Wipes and/or sponges that have been pre-soaked in cleaning solution have similar limitations that often leads to the cleaning solution contacting the consumer's hands. As skin contact with various cleaning solutions may result in skin irritation, it is generally preferable to prevent contact of the cleaning solution with consumers' hands.

BRIEF SUMMARY

Example embodiments described herein provide a product applicator assembly for dispensing and/or applying a cleaning solution, conditioner, or other product to a surface while diminishing the chance that the cleaning solution, conditioner, or other product will contact the consumer's hands. In an example embodiment, the product applicator assembly comprises a handle, an applicator, and a product dispensing assembly. In an example embodiment, the product dispensing assembly comprises a capsule containing a product (e.g., cleaning solution, conditioner, or other product) to be dispensed and/or applied by the product applicator assembly. In an example embodiment, the dispensing assembly further comprises a puncturing device comprising at least one puncturing element configured to puncture the capsule so as to release the product therefrom. The released product may then saturate, at least in part, the applicator. The handle may be configured to not absorb the product and/or to be impervious to the product.

According to one aspect of the present disclosure, a product applicator assembly is provided. In an example embodiment, the assembly comprises a housing having an absorbent portion. The housing defines a hollow interior bounded at least in part by the absorbent portion. The assembly further comprises a product container positioned within the hollow interior. The product container contains a liquid product therein. The housing is at least partially compressible. At least a portion of the housing causes the product container to rupture and to release at least a portion of the liquid product into the absorbent portion of the housing.

According to another aspect of the present disclosure, a product applicator assembly is provided. In an example embodiment, a handle; an applicator; and a product dispensing assembly storing a liquid product within a product container. The handle comprises a handle joining surface and the applicator comprises an applicator joining surface. The handle joining surface is firmly secured to the applicator joining surface. The product dispensing assembly is disposed at least in part within the handle. The product dispensing assembly is configured to selectively release the liquid product into the applicator.

According to another aspect of the present disclosure, a method of applying a liquid product to a surface is provided. In an example embodiment, the method comprises providing a product applicator assembly. The product applicator assembly comprising a housing having an absorbent portion, wherein the housing defines a hollow interior bounded at least in part by the absorbent portion, and a product container positioned within the hollow interior, wherein the product container contains a liquid product therein. The housing is at least partially compressible. The method further comprises compressing the housing, wherein compressing the housing causes at least a portion of the housing to cause the product container to rupture causing the liquid product to saturate, at least in part, the absorbent portion of the housing. The method further comprises moving the product applicator across the surface with an application surface of the absorbent portion of the housing in contact with the surface.

BRIEF DESCRIPTION OF THE SEVERAL VIEWS OF THE DRAWING(S)

Reference will now be made to the accompanying drawings, which are not necessarily drawn to scale, and wherein.

Figure 13:
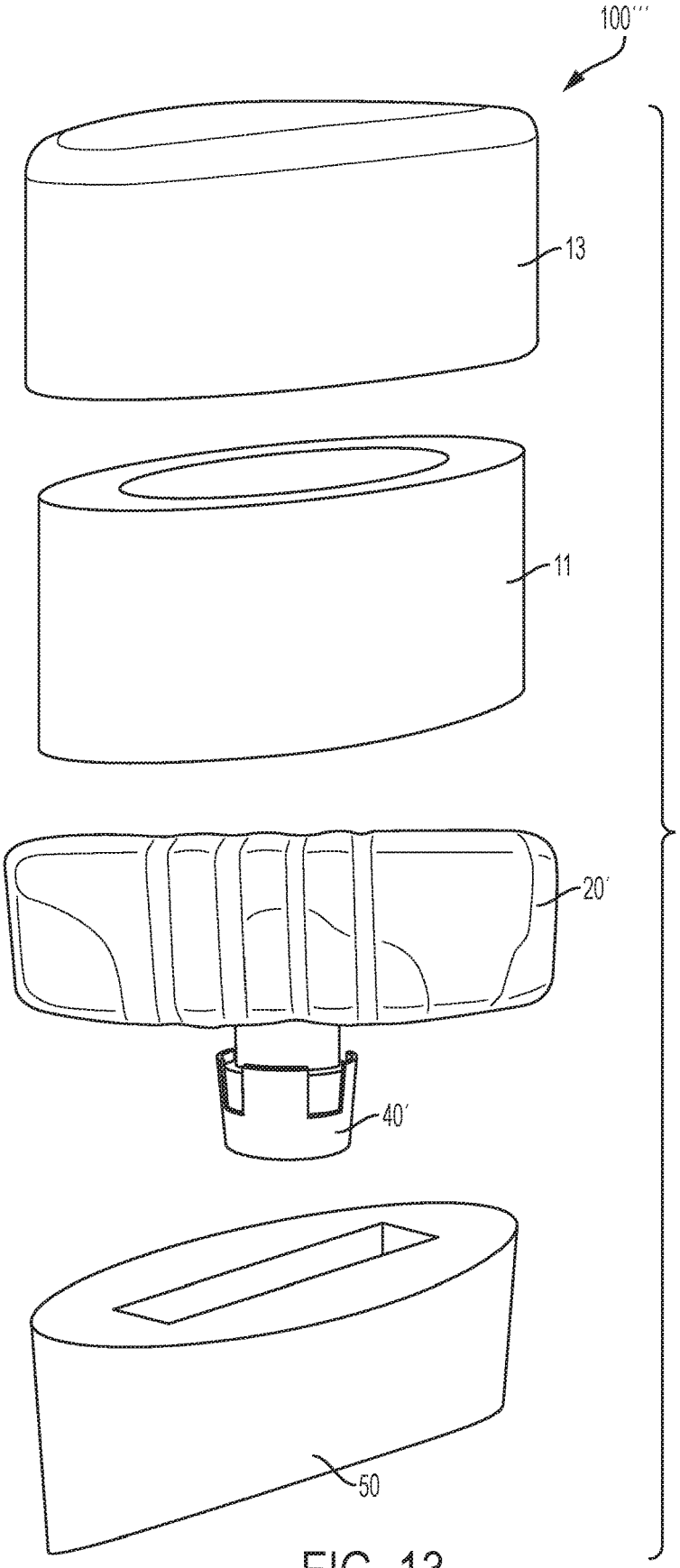
FIG. 13 is an exploded view of another example embodiment of a product applicator assembly.
Figure 15A:
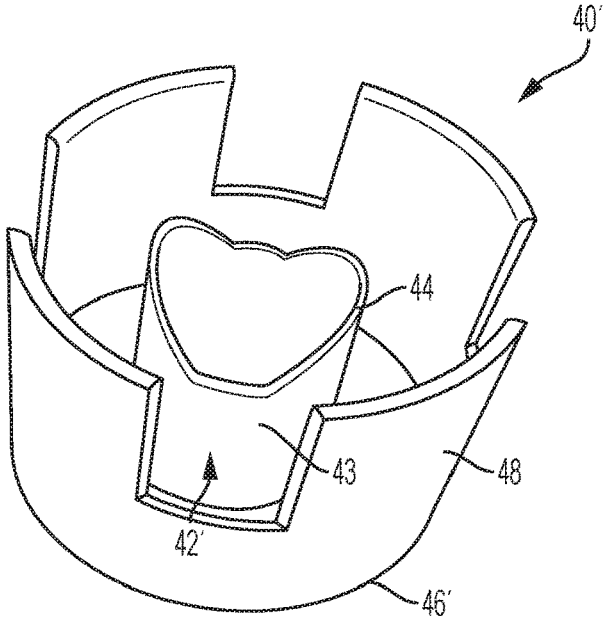
Figure 15B:
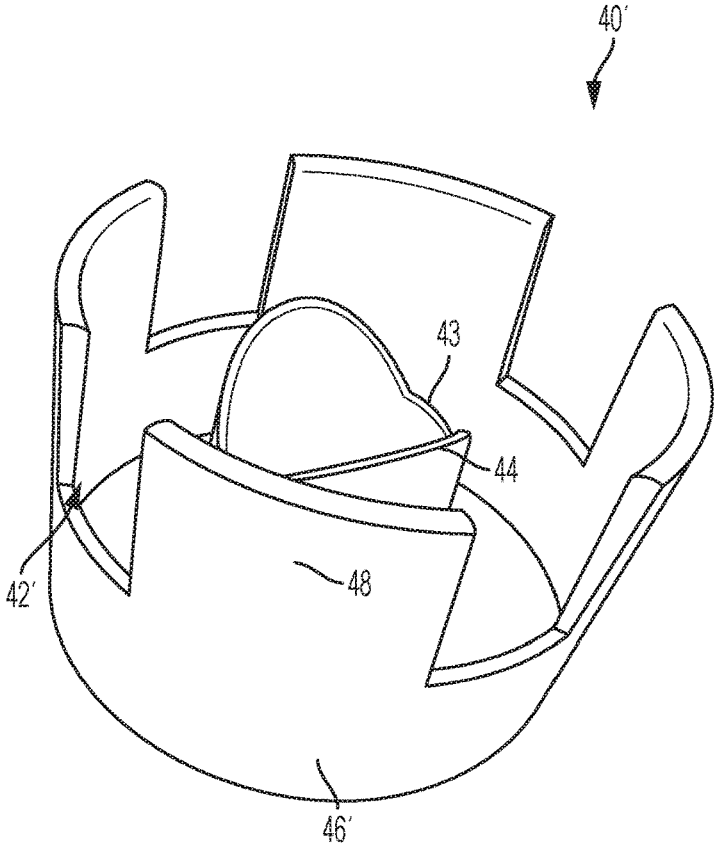
Figure 16:
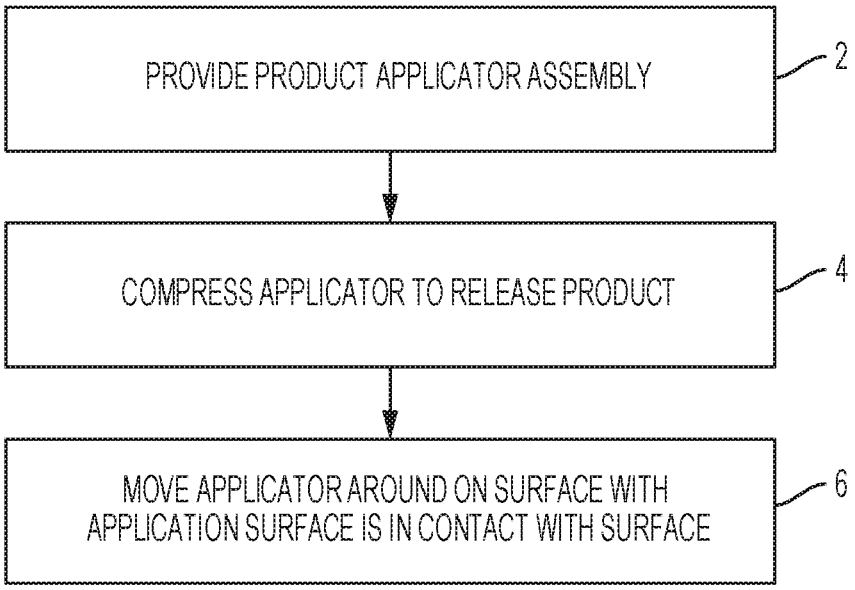

FIGS. 15A and 15B each provide a perspective view of the puncturing device of the example product applicator assembly shown in FIG. 13; and FIG. 16 illustrates a flowchart providing example processes and procedures for using a product applicator assembly of an example embodiment.

DETAILED DESCRIPTION

The present disclosure more fully describes various embodiments with reference to the accompanying drawings. It should be understood that some, but not all embodiments are shown and described herein. Indeed, the embodiments may take many different forms, and accordingly this disclosure should not be construed as limited to the embodiments set forth herein. Rather, these embodiments are provided so that this disclosure will satisfy applicable legal requirements. The term "or" (also designated as"/") is used herein in both the alternative and conjunctive sense, unless otherwise indicated. The terms "illustrative" and "exemplary" are used to be examples with no indication of quality level. As used herein, the term "approximately" refers to within manufacturing and/or engineering tolerances for the corresponding materials and/or elements. Like numbers refer to like elements throughout.

Example embodiments provide a product applicator assembly. In an example embodiment, the product applicator assembly is configured to selectively dispense a product, such as a cleaning solution, conditioner, and/or the like. In an example embodiment, the product applicator assembly comprises a housing. The housing comprises a porous and/or absorbent portion. The housing defines a hollow interior bounded at least in part by the porous and/or absorbent portion. In an example embodiment, the housing further defines a non-porous portion that is generally impervious to the spreadable product to be dispensed via the product applicator assembly. A sealed product container is positioned within the hollow interior of the housing. The sealed product container contains a spreadable product therein (e.g., a liquid, thick or viscous liquid, gel, and/or the like cleaning solution, conditioner, and/or other product). The housing is at least partially compressible. As used herein, the term compressible relates to the ability to be squeezed, condensed, compacted, and/or compressed by pressure applied by the human hand. Compression of the compressible portion of the housing causes the product to be released and/or dispensed from the sealed product container. For example, compression of the compressible portion of the housing may cause the sealed product container to burst.

FIGS. 1-8 provide various views of an example embodiment of a product applicator assembly 100. In the illustrated example embodiment, the housing 5 of the product applicator assembly 100 comprises a handle 10 and an applicator 50, wherein the applicator 50 is the porous and/or absorbent or otherwise permeable portion of the housing and the handle 10 is non-absorbent portion of the housing. The handle 10 comprises a handle joining surface 18. The applicator 50 comprises an applicator joining surface 58. The handle joining surface 18 of the handle 10 is firmly secured, attached, and/or the like to the applicator joining surface 58 of the applicator 50. Embedded, disposed, and/or the like within the handle 10 and/or applicator 50 is a product dispensing assembly 30 comprising the sealed product container. For example, the handle 10 may comprise a handle recess 12 and/or the applicator 50 may comprise and applicator recess 52 such that the housing 5 (e.g., the handle 10 and the applicator 50) defines a hollow interior of the housing 5 that is at least partially bounded by the porous and/or absorbent portion of the housing 5 (e.g., the applicator 50) and within which the sealed product container may be disposed. In an example embodiment, the handle joining surface 18 is firmly secured to the applicator joining surface 58 such that the hollow interior, the sealed product container, and/or the product dispensing assembly 30 is not readily accessible to a consumer.

The product dispensing assembly 30 comprises the sealed product container. In an example embodiment, the product dispensing assembly 30 comprises a sealed product container or reservoir containing a product 310 and a mechanism for selectively releasing and/or dispensing the product from the container or reservoir. For example, in the illustrated example embodiment, the product dispensing assembly 30 comprises a capsule 20 as the sealed product container or reservoir and a puncturing device 40. For example, the capsule 20 may store product 310 sealed therein and the puncturing device 40 may be configured to puncture the capsule to release the product from the capsule.

Figure 10:
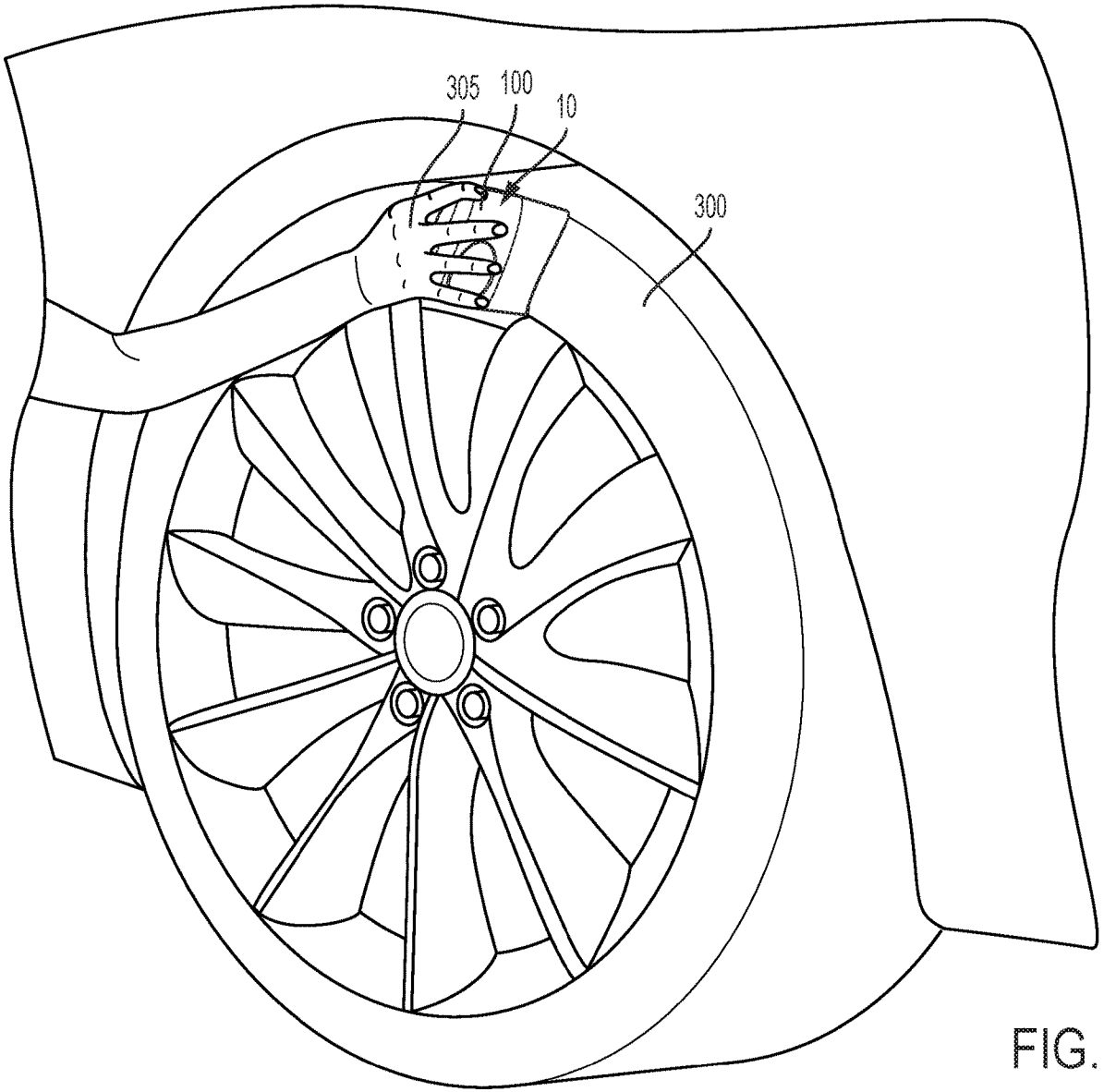
FIG. 10 illustrates an example of a consumer using a product applicator assembly of an example embodiment.

For example, as shown in FIG. 10, a consumer may hold the product applicator assembly 100 with the consumer's hand 305 and use the product applicator assembly 100 to apply the product 310 to a surface 300. In an example embodiment, the surface 300 may be a contoured surface, such as a tire, for example, or a generally flat surface, such as a window or car seat, for example. Some non-limiting examples of products 310 that may be dispensed and/or applied by a product applicator assembly 100 include leather cleaner, leather conditioner, tire cleaner, tire shine, wheel cleaner, window cleaner, multi-surface cleaner, and/or the like. In an example embodiment, the product 310 may be a liquid product, thick or viscous liquid product, or a gel product. Various features of the product applicator assembly 100 will now be described in more detail.

Figure 5:
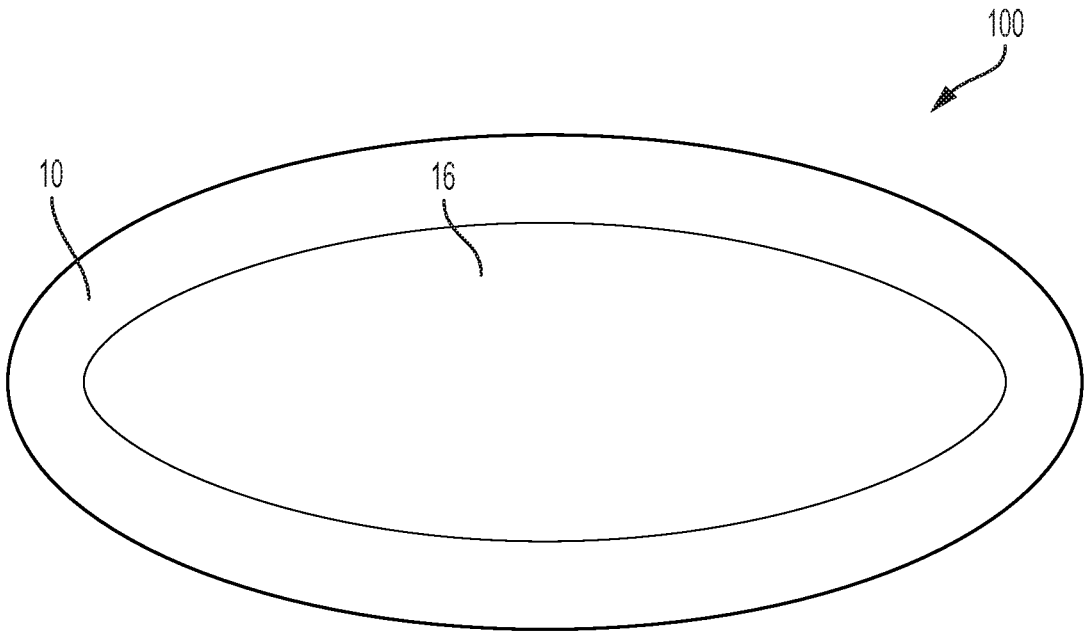
FIG. 5 is a top elevation view of a product applicator assembly, according to an example embodiment.
Figure 6:
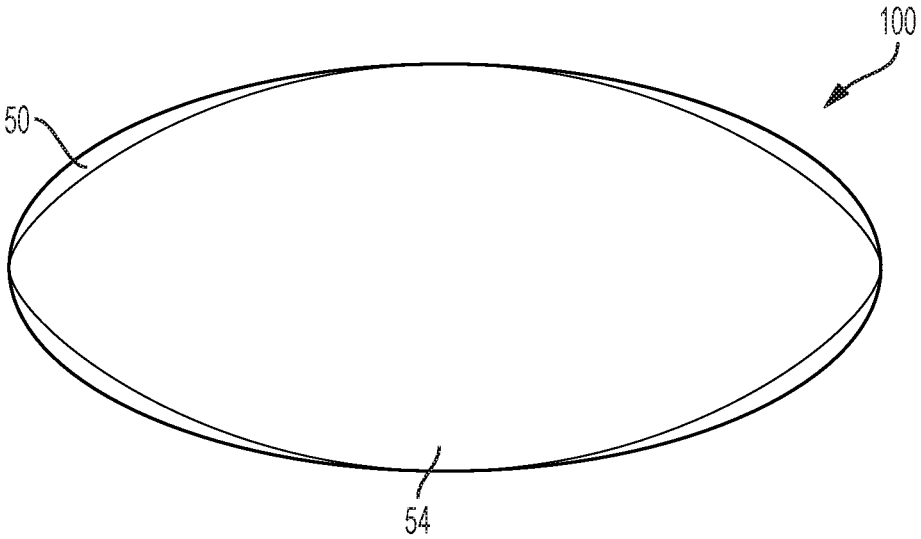
FIG. 6 is a bottom elevation view of a product applicator assembly, according to an example embodiment.

In an example embodiment, the handle 10 may be configured to be held by a consumer (e.g., with a consumer's hand 305) while the consumer is using the product applicator assembly 100 to apply a product 310 (e.g., cleaning solution, conditioner, and/or the like) to a surface 300. In an example embodiment, the handle 10 may be configured to fit in the palm of a consumer's hand 305. For example, the product applicator assembly 100 may be generally elliptically-shaped (e.g., an elliptical prism as seen in FIGS. 5 and 6), generally rectangular (e.g., a rectangular prism), and/or the like and sized to fit in a consumer's hand 305. For example, the handle 10 may optionally comprise ergonomic features such as indents and/or contours 14, 16. In an example embodiment, the handle 10 may comprise an elongated portion such that the consumer's hand 305, when the consumer is holding the handle with their hand 305, is located a distance from the applicator 50. For example, the handle 10 may comprise an elongated portion such that the consumer's hand 305 may be located one or two inches from the applicator 50, a foot from the applicator 50, half a meter from the applicator 50, a meter from the applicator 50, and/or the like. As non-limiting examples, the elongated portion of the handle 10 may be similar to a broom handle or toilet brush handle.

In an example embodiment, the handle 10 may comprise a handle recess 12. The handle recess 12 may be configured to receive at least a portion of the product dispensing assembly 30 therein. For example, the handle recess 12 may be sized to receive a capsule 20 therein. For example, the handle recess 12 may be sized such that the capsule 20 may be at least partially recessed and/or disposed therein. In an example embodiment, the handle joining surface 18 comprises the opening of the handle recess 12. For example, the handle recess 12 may be a recess, indentation, hole (e.g., blind-hole or through hole), and/or the like within and/or accessible via the handle joining surface 18.

In an example embodiment, the handle 10 is generally impervious to the product 310 stored within the product applicator assembly 100 and/or to be dispensed and/or applied via the product applicator assembly 100. For example, the handle 10 may be non-porous and/or non-absorbent. For example, the applicator 50 may be at least partially saturated with a product 310 (e.g., a cleaning solution, conditioner, and/or other liquid, thick or viscous liquid, or gel product) and the handle 10 may be configured to prevent and/or reduce the chance that the product contacts the consumer's hands 305 as the consumer uses the product applicator assembly 100 to apply the product to a surface. For example, the handle 10 may be generally impervious to the product 310. For example, the handle 10 may be made of a material that does not generally absorb the product 310. In some example embodiments, the handle 10 may be rigid or at least partially flexible, and may be made of a material that is rigid, flexible or resilient, such as for example, closed cell sponge, an ethylene-vinyl acetate (EVA) sponge, a sponge made of another polymer or copolymer, plastic, wood, foam rubber, and/or the like. For example, in some embodiments the handle 10 may be made of a blow molded plastic. In some embodiments, the handle 10 may be opaque, translucent, and/or transparent or semi-transparent. In an example embodiment, the handle 10 may be colored and/or tinted with a color indicative of the type of product 310 stored therein. In some embodiments, the handle 10 is at least semi-transparent such that the product 310, or a quantity of the product, stored therein is at least partially viewable. For example, the handle 10 of a product applicator assembly 100 storing window cleaner therein and/or configured to dispense and/or apply window cleaner to a surface may be colored and/or tinted blue. In another example embodiment, the handle 10 of a product applicator assembly 100 storing a leather cleaner therein and/or configured to dispense and/or apply leather cleaner to a surface may be colored and/or tinted light brown and the handle 10 of a product applicator assembly 100 storing a leather conditioner therein and/or configured to dispense and/or apply leather conditioner to a surface 300 may be colored and/or tinted dark brown. Such color choices are non-limiting and provided for exemplary purposes only. In various embodiments, the handle 10 may take various forms and be configured to allow the consumer to hold, grip and/or control the product applicator assembly 100 with their hands 305 while preventing and/or reducing the chance that product 310 will get on the consumer's hands 305. In some embodiments, the handle 10, applicator 50 and/or other portions of the device may be made of natural or biodegradable materials.

In an example embodiment, the applicator 50 is configured to apply the product 310 stored within the product applicator assembly 100 (e.g., within the capsule 20) to a surface 300 after the product has been selectively dispensed. For example, after a consumer has caused the product dispensing assembly 30 to dispense the product 310, the product at least partially saturates the applicator 50 at least in part. The consumer may then move the product applicator assembly 100 across a surface 300 with the applicator 50 in contact with the surface 300 to cause the product 310 to be applied to the surface 300. In an example embodiment, the applicator 50 is made of an open-cell sponge. For example, the applicator 50 may be made of a synthetic, porous sponge. In some embodiments, the handle 10 is flexible or resilient and squeezing or otherwise applying pressure to the handle 10 may increase the rate at which the product 310 is dispensed from capsule 20.

In an example embodiment, the applicator 50 may comprise an application surface 54. The application surface 54 is generally opposite the applicator joining surface 58, in an example embodiment. In an example embodiment, the application surface 54 may be contoured or shaped to approximately correspond to an expected surface shape. For example, the application surface 54 may be a curved surface. The curve of the application surface 54 may be configured to match the surface 300 the product is expected to be applied to. For example, if the product stored and/or to be dispensed from and/or applied by the product applicator assembly 100 is tire shine, the application surface 54 may be contoured to generally match the surface of a tire. In another example, if the product stored and/or to be dispensed from and/or applied by the product applicator assembly 100 is window cleaner, the application surface 54 may be generally planar. In an example embodiment, a portion of the application surface 54 may have a different texture than another portion of the application surface 54. For example, a portion of the application surface 54 may have a courser texture for scrubbing the surface 300.

In an example embodiment, the applicator 50 may comprise an applicator recess 52, which may be a hollow cavity or the like. The applicator recess 52 may be configured to receive at least a portion of the product dispensing assembly 30 therein. For example, the applicator recess 52 may be sized to receive a puncturing device 40 therein. For example, the applicator recess 52 may be sized and shaped such that the puncturing device 40 may be at least partially recessed and/or disposed therein. In an example embodiment, the puncturing device 40 is formed into the applicator recess 52. In an example embodiment, the applicator joining surface 58 comprises the opening of the applicator recess 52. For example, the applicator recess 52 may be a recess, indentation, hole, cavity, and/or the like within and/or accessible via the applicator joining surface 58.

In an example embodiment, a product dispensing assembly 30 is embedded, disposed, enclosed, and/or the like within the product applicator assembly 100. For example, a product dispensing assembly may be embedded, disposed, enclosed, and/or the like within the handle recess 12 and/or the applicator recess 52. In an example embodiment, a product dispensing assembly 30 comprises a reservoir for containing, storing, holding, and/or the like a product 310 (e.g., a liquid, thick or viscous liquid, or gel cleaning solution, conditioner, or other product). In an example embodiment, the product dispensing assembly 30 further comprises a mechanism for selectively releasing and/or dispensing the product 310 from the reservoir.

Figure 7:
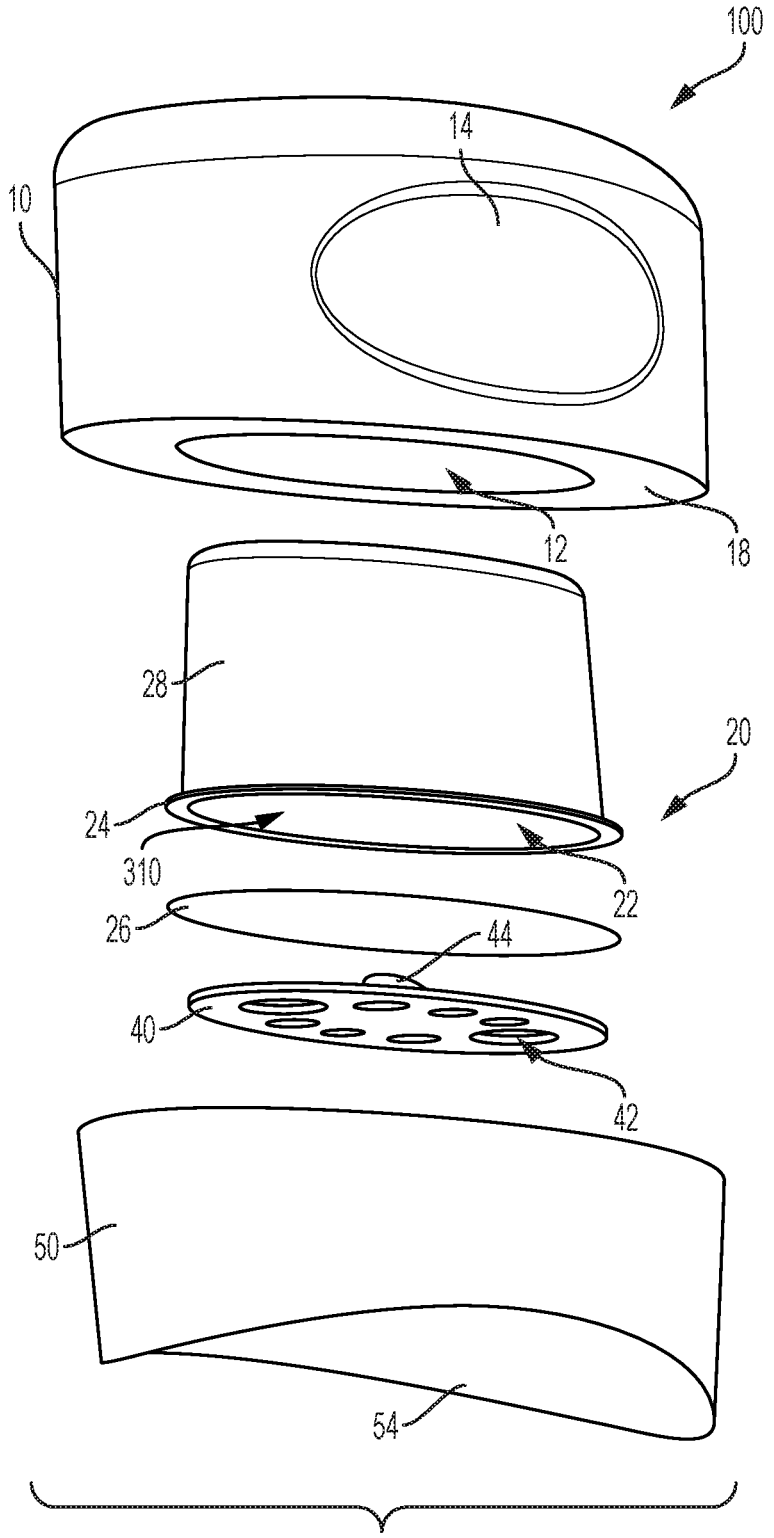
FIG. 7 is a bottom perspective exploded view of a product applicator assembly, according to an example embodiment.
Figure 8:
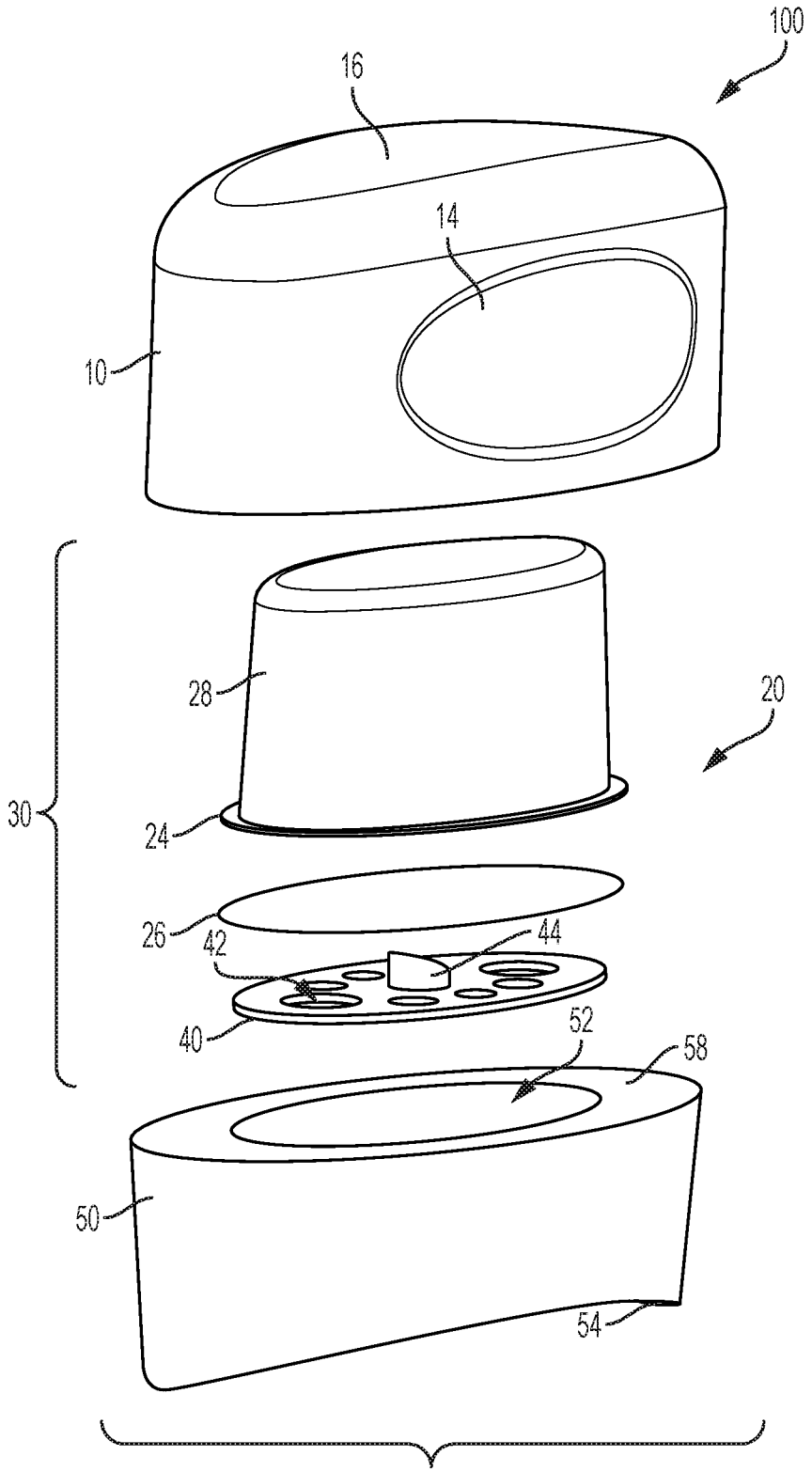
FIG. 8 is a top perspective exploded view of a product applicator assembly, according to an example embodiment.

In the illustrated example embodiment of FIGS. 7 and 8, the product dispensing assembly 30 comprises a capsule 20 and a puncturing device 40. In an example embodiment, the capsule 20 comprises a cup 28 and a seal 26. The cup 28 may comprise a holding compartment 22 configured to contain, store, and/or hold the product 310 therein. The seal 26 may enclose the holding compartment 22 so as to seal the product 310 within the holding compartment 22 of the cup 28. In an example embodiment, the seal 26 is a foil seal. In various embodiments, various seals 26 may be employed to seal the product 310 within the holding compartment 22 of the cup 28. In an example embodiment, the holding compartment 22 may be sized and/or otherwise configured to contain, store, hold and/or the like one to two ounces of product 310. The size of the holding compartment 22 may vary between various embodiments based on the intended application. In an example embodiment, the cup 28 is made of plastic, a polymer or copolymer material, and/or the like. In an example embodiment, the cup 28 comprise a lip 24 about the opening of the holding compartment 22. The lip 24 may provide a surface to which the seal 26 may be adhered, sealed, attached, and/or the like. In various embodiments, the capsule 20 is disposed within the handle recess 12 such that the opening of the holding compartment 22 faces, points toward, and/or the like the handle joining surface 18. In an example embodiment, the seal 26 may define a seal plane and the handle joining surface 18 may define a surface plane, wherein the seal plane and the surface plane may be parallel or approximately parallel. In one example embodiment, the seal plane and the surface plane are coplanar. For example, in one example embodiment, the seal 26 is approximately flush with the handle joining surface 18. However, in another example embodiment, the seal 26 is at least partially recessed within the handle recess 12 and in another example embodiment, the cup 28 extends at least partially out of the handle recess 12.

In an example embodiment, the puncturing device 40 is configured to selectively release and/or dispense product 310 from the capsule. In an example embodiment, the puncturing device 40 further comprises one or more puncture elements 44 configured, engineered, and/or the like to puncture, rupture, pierce, and/or the like the capsule 20. For example, the one or more puncture elements may be configured, engineered, and/or the like and disposed, placed, and/or the like to selectively puncture the seal 26. For example, the one or more puncture elements 44 may be configured, engineered, and/or the like and disposed, placed, and/or the like to pierce or otherwise selectively cause one or more holes in the seal 26 and/or other portion of the capsule 20 such that the product 310 may flow, be dispensed, be released, and/or the like from the capsule 20. In the illustrated embodiment, the puncturing device 40 may comprise a base element 46. In an example embodiment, the base element 46 is approximately planar. In an example embodiment, the one or more puncture elements 44 extend outward and/or away from the base element 46. In an example embodiment in which the puncturing element is formed into the applicator recess 52, the puncture elements 44 may extend outward from a bottom surface of the applicator recess 52 toward the capsule 20 and/or seal 26. In an example embodiment, the puncturing device 40 is made of rigid plastic, aluminum, and/or other appropriate material capable of piercing or puncturing seal 26. In another embodiment, seal 26 is made from a semi-permeable membrane, whereby application of sufficient pressure to capsule 20, for example by squeezing handle 10, will cause the product 310 to permeate through the semi-permeable membrane without needing to be pierced or punctured.

In an example embodiment, the base element 46 has approximately the same outer dimensions as the lip 24 of the cup 28. For example, the base element 46 may be sized such that when the puncture elements 44 puncture the seal, for example, the base element 46 engages the lip 24 such that the base element 46 does not enter the hold compartment 22. For example, the base element 46 may be sized such that the base element 46 does extend significantly past the lip 24 of the cup 28. For example, the base element 46 may be sized such that the periphery of the base element 46 does not cause significant damage and/or ripping of the applicator 50 when the product applicator assembly 100 is used to apply a product 310 to a surface 300.

Figure 9A:
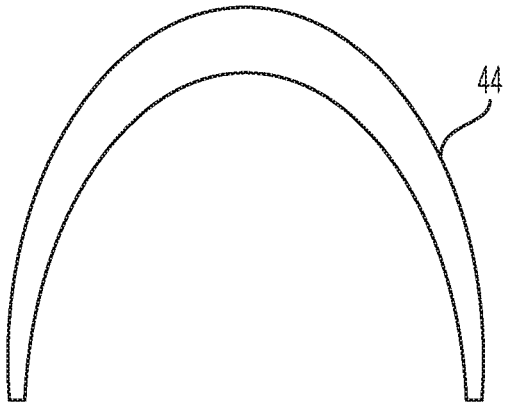
FIG. 9A is a planar view of a puncture element, according to an example embodiment.
Figure 9B:
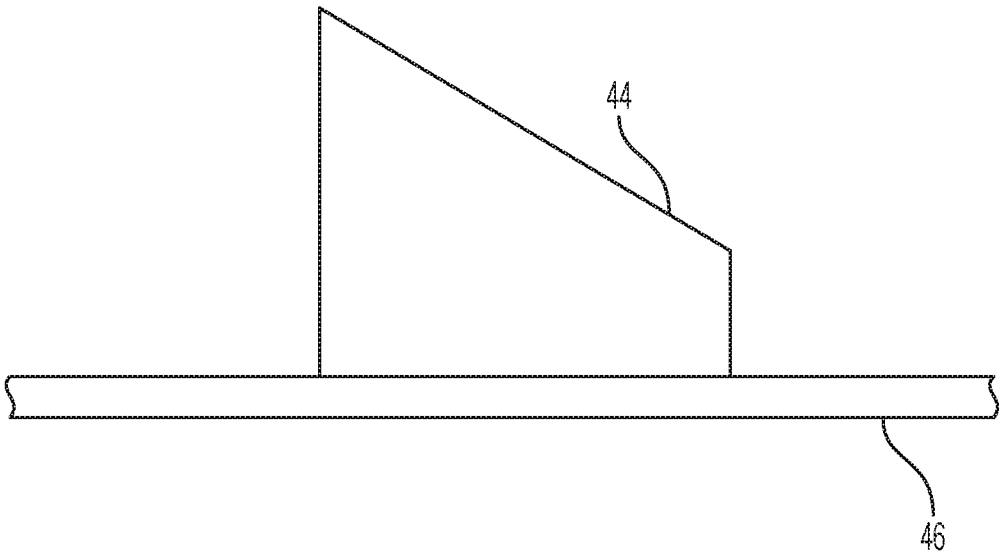
FIG. 9B is an elevation view of a puncture element, according to an example embodiment.

FIG. 9A provides a planar view of an example puncture element 44 and FIG. 9B provides an elevation view of an example puncture element 44. In various embodiments, a cross-section of a puncture element 44 taken parallel to a plane defined by the base element 46 is curved, angled, or linear. For example, the plan view shown in FIG. 9A illustrates an example puncture element 44 in which a cross-section taken parallel to a plane defined by the base element 46 is curved. In an example embodiment, a puncture element 44 is tapered. For example, the elevation view shown in FIG. 9B, the puncture element 44 extends outward and/or away from the base element 46 in a tapered manner. For example, in an example embodiment, a portion of the puncture element 44 extends outward and/or away from the base element 46 to a larger extent or distance than another portion of the puncture element 44.

In an example embodiment, the puncturing device 40 may comprise a plurality of puncture elements 44. For example, the puncturing device 40 may comprise two or more puncture elements 44 that are positioned on the puncturing device 40 in a spaced apart manner. For example, if the base element 46 is elliptically-shaped, a first puncture element 44 may be positioned at approximately a first focal point and a second puncture element 44 may be positioned at approximately a second focal point, in an example embodiment. In various embodiments, a plurality of puncture elements 44 may be positioned on the puncturing device 40 in a spaced apart manner in a variety of configurations. In an example embodiment, the puncturing device 40 is rectangular (e.g., the base element 46 is rectangular in shape). The puncturing device 40 of this example embodiment may comprise a first puncture element 44 at a first end of the base element 46, a second puncture element 44 at second end of the base element 46 that is opposite the first end, and a third puncture element 44 in the middle (e.g., center) of the base element 46.

In an example embodiment, the base element 46 may comprise one or more holes 42 therein and/or passing there-through. For example, one or more holes 42 through the base element 46 may be configured to allow product 310 to flow there-through. For example, the one or more holes 42 may be configured to allow product 310 to flow through the puncturing device 40 so that the product may saturate, at least in part, the applicator 50 so that the product may be dispensed and/or applied through the applicator 50. In an example embodiment, the one or more holes 42 are positioned about a periphery of the base element 46 so as to cause dispersion of the product 310 throughout the applicator 50.

In an example embodiment, the puncturing device 40 may be disposed in the applicator recess 52. For example, the puncturing device 40 may be positioned such that the one or more puncture elements extend outward and/or away from the base element 46 and toward the capsule 20. For example, the puncturing device 40 may be disposed such that one or more puncture elements 44 may extend outward and/or away from the base element 46 and toward the seal 26. For example, one or more puncture elements 44 may be positioned adjacent the seal 26 and/or other portion of the capsule 20. When the applicator 50 is compressed, the puncturing device 40 may move, translate, and/or be pushed such that the one or more puncture elements 44 contact the seal 26 and/or other portion of the capsule 20. If sufficient compressing pressure and/or force is applied to at least a portion of the housing 5 (e.g., applicator 50), the puncture elements 44 will puncture the seal 26 and/or other element of the capsule 20, thereby releasing the product from the capsule. In an example embodiment, the capsule 20 may be pressurized and/or otherwise configured such that when the seal 26 and/or other portion of the capsule 20 is punctured by one or more puncture elements 44, an audible indicator of the puncture is provided. For example, in one example embodiment, the seal may be configured such that the puncturing of the seal 26 by the one or more puncture elements 44 puncture the seal 26 may cause an audible "pop" sound. For example, the thickness and/or material properties of seal 26 and/or puncture elements 44 may be chosen such that puncturing of the seal takes sufficient force to create an audible indicator that the seal 26 has been punctured. The audible indicator of the puncture may provide a consumer with an indication or notification that the product has been released from the capsule 20.

Figure 1:
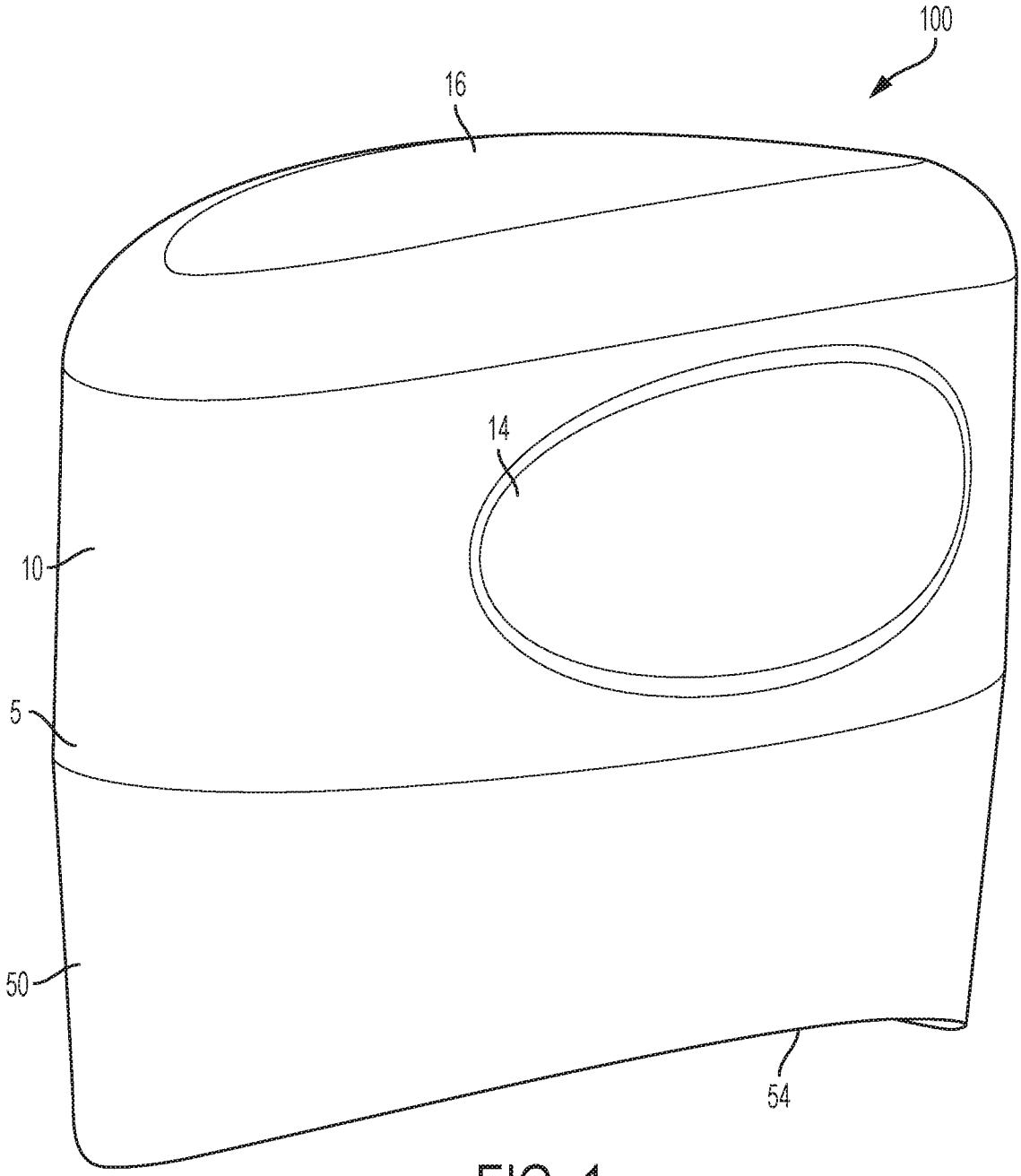
FIG. 1 is a top perspective view of an applicator assembly, according to an example embodiment.
Figure 2:
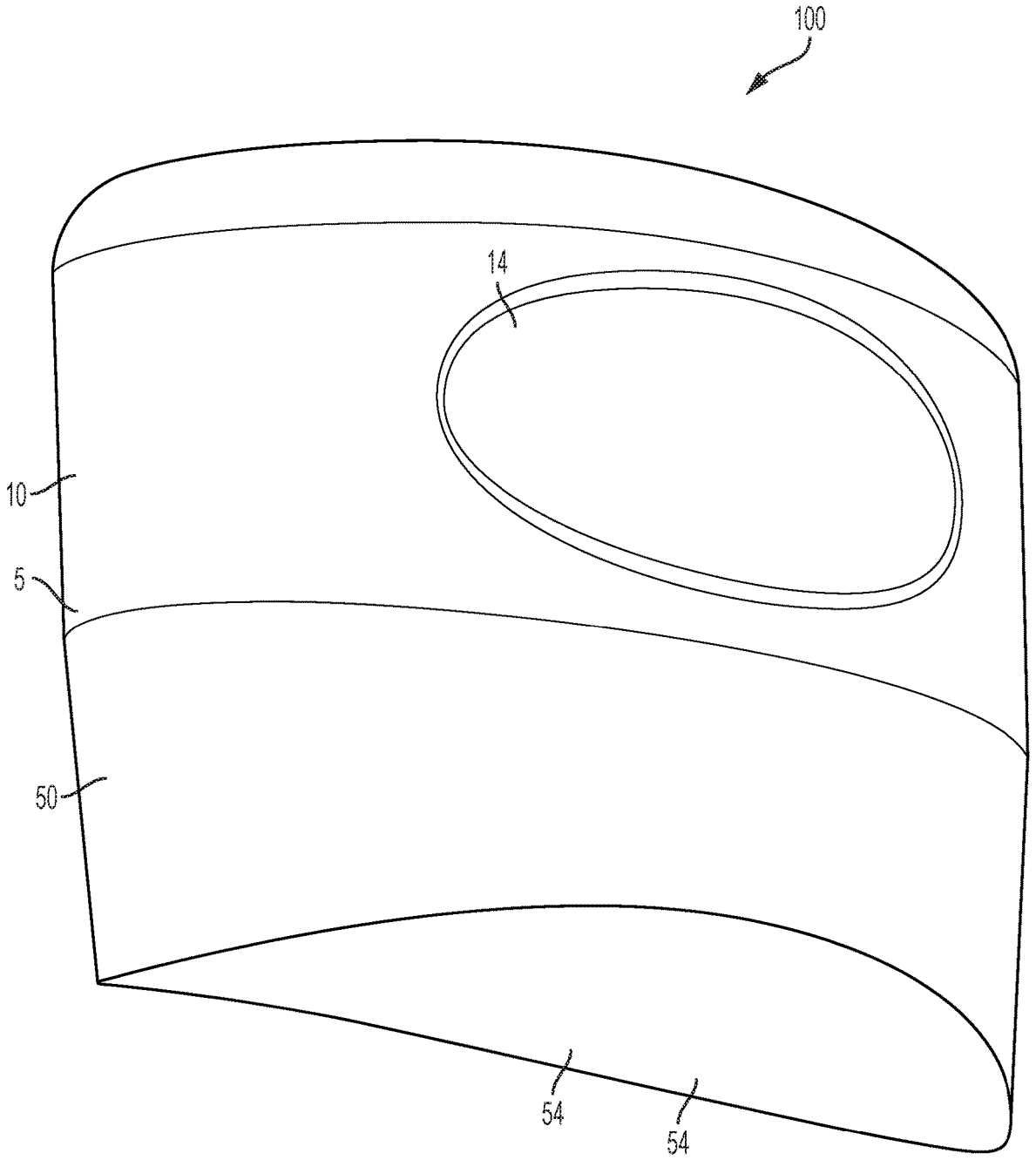
FIG. 2 is a bottom perspective view of a product applicator assembly, according to an example embodiment.
Figure 3:
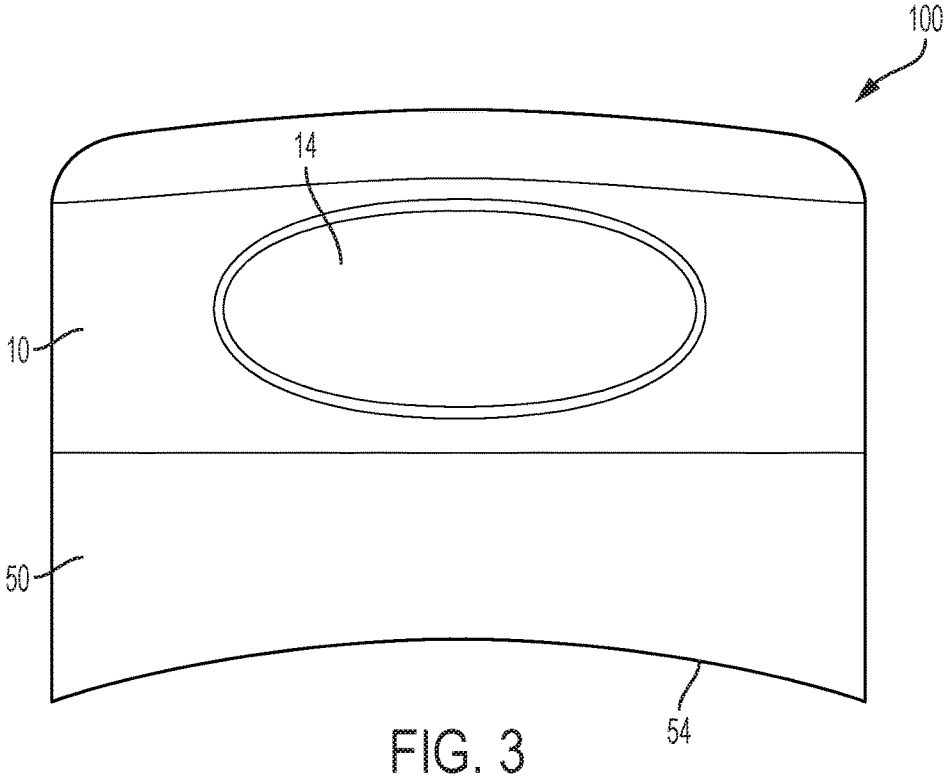
FIG. 3 is a side elevation view of a first side of a product applicator assembly, according to an example embodiment.
Figure 4:
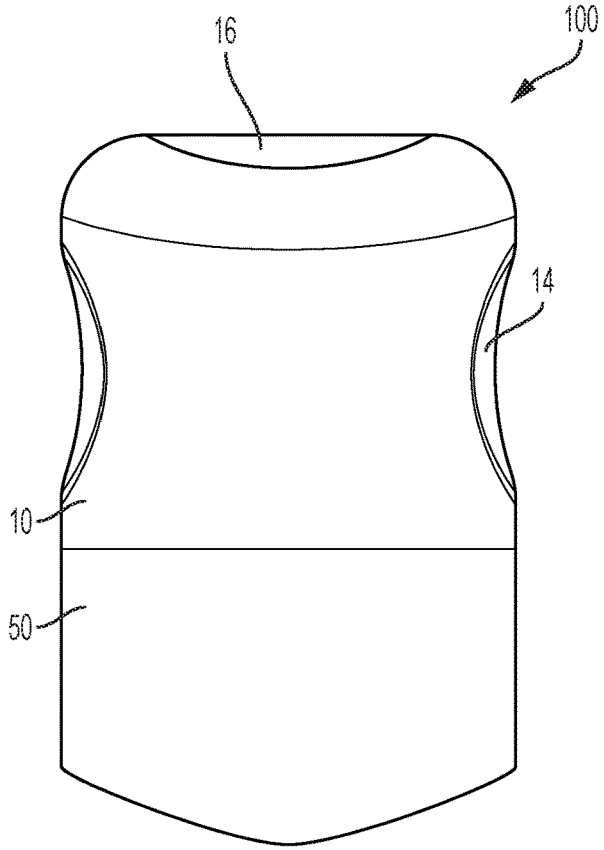
FIG. 4 is a side elevation view of a second side of a product applicator assembly, according to an example embodiment.

In an example embodiment, the relationship between a puncturing device 40 and the capsule 20 may define a dispensing axis 35, as shown in FIG. 3. For example, a puncture element 44 may extend out from a puncturing device 40 in a first direction. The capsule 20 may be positioned such that the seal 26 is disposed along the first direction from the puncturing device 40. The first direction may be parallel or approximately parallel to the dispensing axis 35. In an example embodiment, the applicator 50 is compressed along the dispensing axis 35 to cause the product 310 to be released and/or dispensed from the capsule 20.

Figure 11:
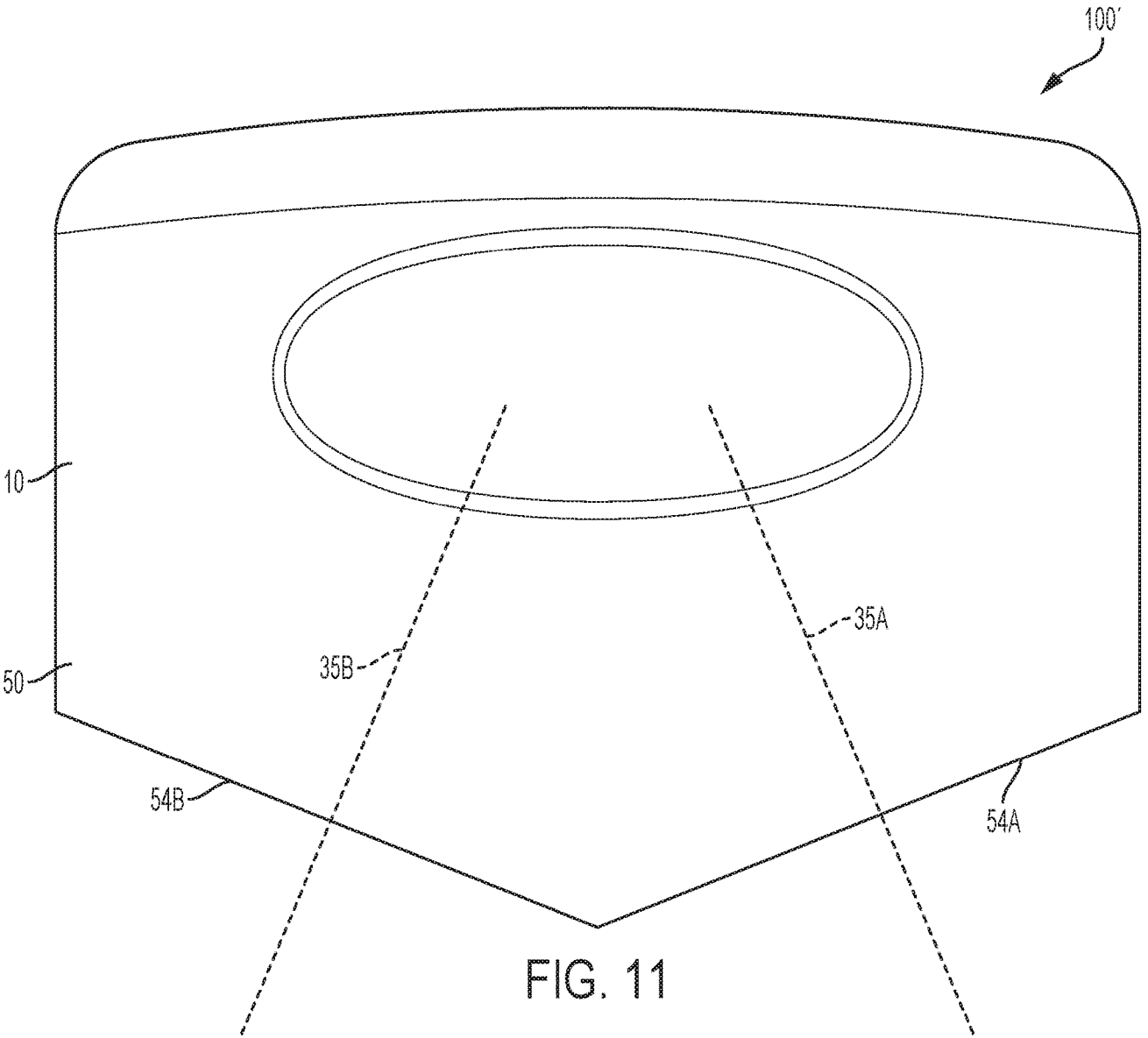
FIG. 11 is an elevation view of first side of a product applicator assembly, according to an example embodiment.

FIG. 11 shows an elevation view of another example embodiment of a product applicator assembly 100'. In the illustrated example embodiment, a product applicator assembly 100' comprises more than one product 310 to be dispensed. For example, in the illustrated example embodiment, the product applicator assembly 100' may comprise two capsules 20. The two capsules may store the same product or different products. In such an example, the applicator 50 may comprise two application surfaces 54A, 54B. Each of the application surfaces 54A, 54B may be a planar surface or a curved or contoured surface. In an example embodiment, a first capsule 20 of the two capsules may be associated with a first application surface 54A of the two application surfaces and a first puncturing device 40. The first puncturing device 40 and the first capsule 20 may be disposed, configured, positioned, and/or the like such that when the applicator 50 is compressed by pressing the first application surface 54A against a surface such that the applicator is compressed along a first dispensing axis 35A, a first product is released and/or dispensed from the first capsule. Similarly, a second capsule 20 of the two capsules may be associated with a second application surface 54B of the two application surfaces and a second puncturing device 40. The second puncturing device 40 and the second capsule 20 may be disposed, configured, positioned, and/or the like such that when the applicator 50 is compressed by pressing the second application surface 54B against a surface such that the applicator is compressed along a second dispensing axis 35B, a second product is released and/or dispensed from the second capsule. The first dispensing axis 35A and the second dispensing axis 35B may be not parallel. In an example embodiment, the first dispensing axis 35A and the second dispensing axis 35B may be perpendicular to each other. In an example embodiment, the first application surface 54A defines a first plane and the second application surface 54B defines a second plane, wherein the first plane and the second plane are not parallel. Thus, in an example embodiment, a product applicator assembly 100' may comprise two products that may be used in succession by allowing a first product to be selectively dispensed and/or applied via the first application surface followed by the selective dispensing and/or application of a second product via the second application surface.

Figure 12A:
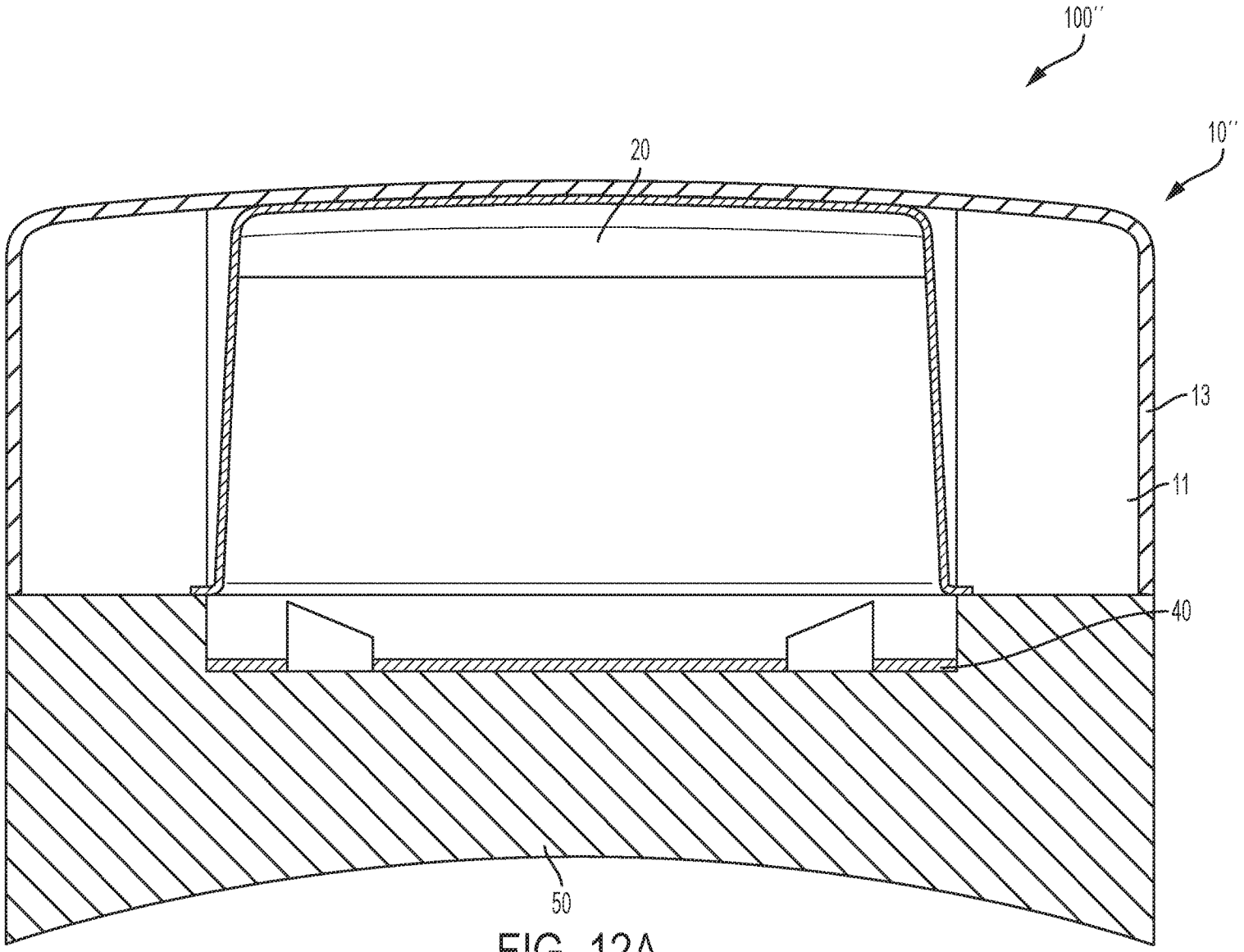
FIG. 12A is cross-section view of a product applicator assembly, according to an example embodiment.
Figure 12B:
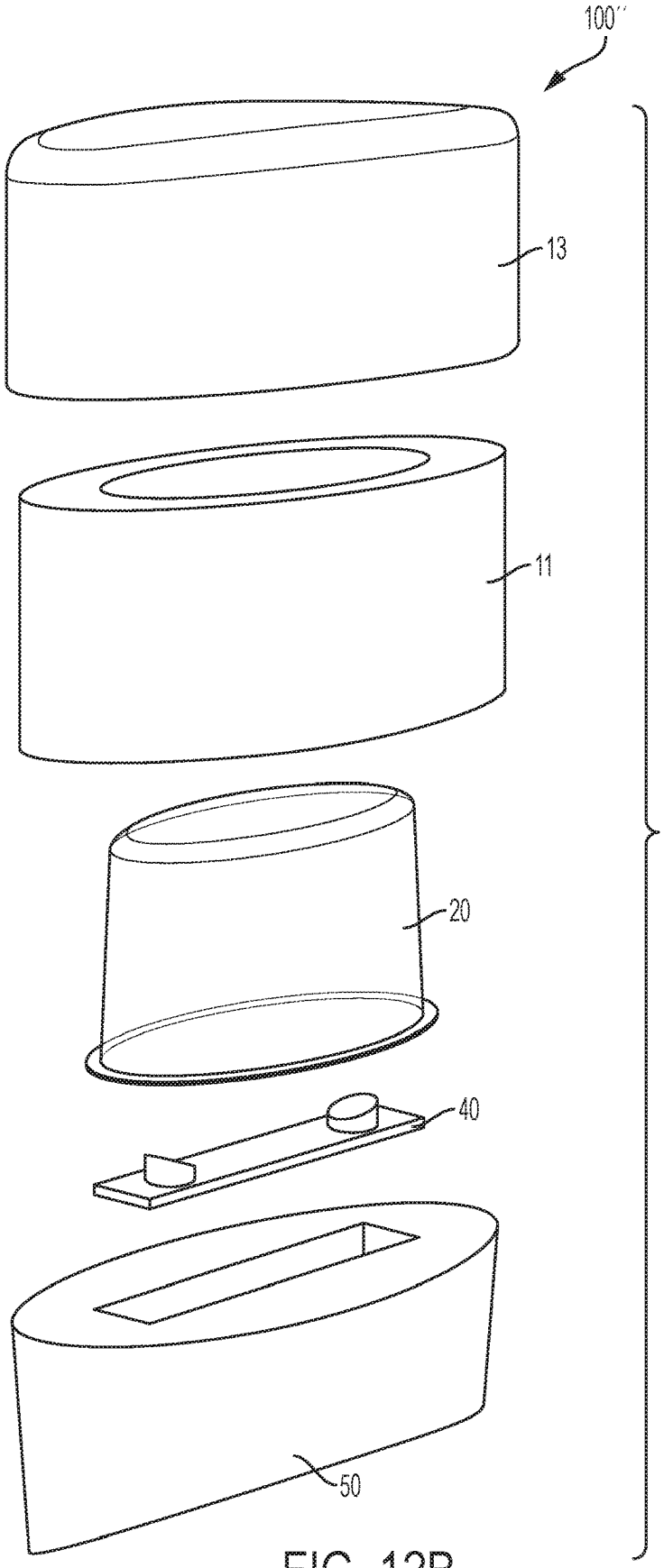
FIG. 12B is an exploded view of the product applicator assembly shown in FIG. 12A.

FIGS. 12A and 12B illustrate another example embodiment of a product applicator assembly 100". In the illustrated embodiment, the absorbent portion of the housing comprises applicator 50 and the non-absorbent portion of the housing comprises shell 13 and handle form 11. The shell 13 may be made of polypropylene, a plastic and/or polymer material, silicon, and/or the like. The handle form 11 may comprise a closed cell foam, and/or the like. For example, the handle form 11 may comprise the handle recess 12 for receiving the capsule 20 therein, provide protection for the capsule 20, provide a handle that is sized to fit comfortably within a consumer's hand, and/or the like. The shell 13 may fit over the handle form 11 to provide an impervious, non-absorbent barrier to reduce the chance of the consumer's hand 305 coming in contact with the cleaning solution to be applied via the product applicator assembly 100".

FIG. 13 provides an exploded view of another example embodiment of the product applicator assembly 100'". Similar to the embodiment shown in FIGS. 12A and 12B, the absorbent portion of the housing 5 of the product applicator assembly 100' comprises applicator 50 and the non-absorbent portion of the housing comprises shell 13 and handle form 11. The shell 13 may be made of polypropylene, a plastic and/or polymer material, silicon, and/or the like. The handle form 11 may comprise a closed cell foam, and/or the like. For example, the handle form 11 may comprise the handle recess 12 for receiving the capsule 20' therein, provide protection for the capsule 20', provide a handle that is sized to fit comfortably within a consumer's hand, and/or the like. The shell 13 may fit over the handle form 11 to provide an impervious, non-absorbent barrier to reduce the chance of the consumer's hand 305 coming in contact with the cleaning solution to be applied via the product applicator assembly 100".

Figure 14:
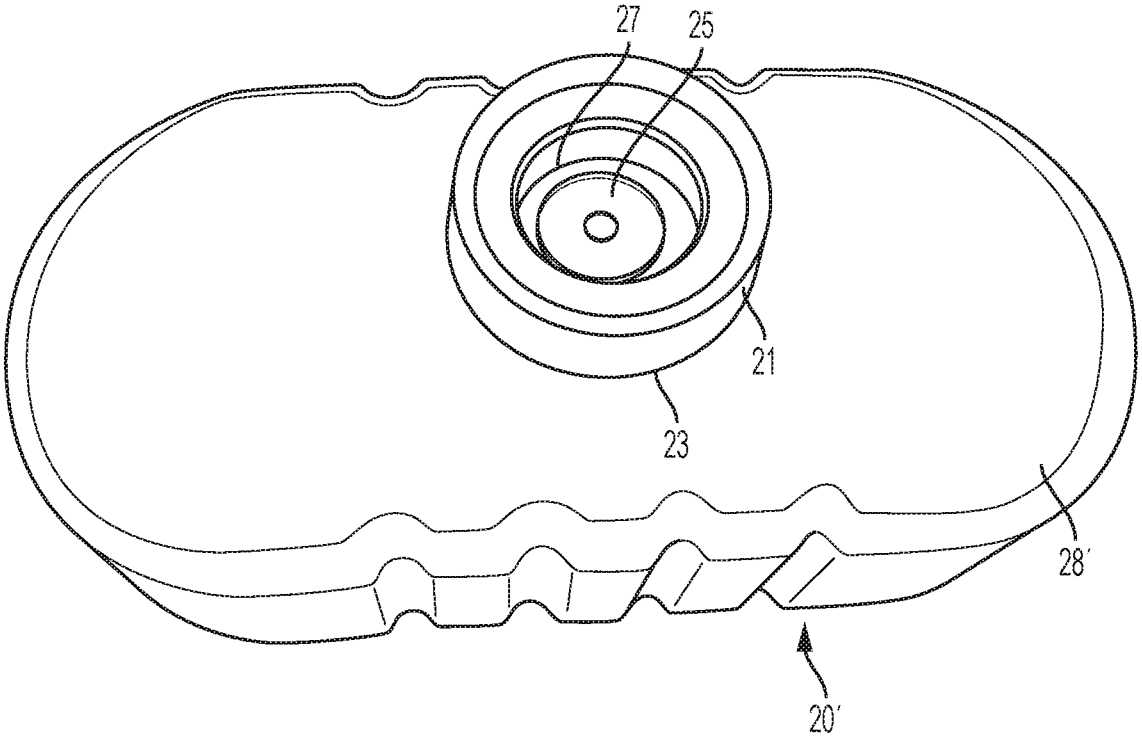
FIG. 14 is a perspective view of the capsule of the example product applicator assembly shown in FIG. 13.

As shown in FIG. 14, the capsule 20' may comprise a cup 28'. The cup 28' may comprise a holding compartment 22 configured to contain, store, and/or hold the product 310 therein. The capsule 20' may further comprise a neck 21 extending from the cup 28'. The neck may comprise a flange 23, a seal 25, and a puncturable portion 27. In an example embodiment, a mating member 48 of the puncturing device 40' (see FIGS. 15A and 15B) may be seated against the flange 23 prior to the release of the liquid product from the capsule 20'. The seal 25 is disposed at an end of the neck 21 opposite the cup 28'. The seal 25 may act to seal and/or enclose the product 310 within the cup 28' until the puncturing of the puncturable portion 27. In an example embodiment, the puncturable portion 27 is a portion of the seal 25 that is thinner or otherwise weakened with respect to the remainder of the seal 25. For example, in the illustrated embodiment, the puncturable portion 27 is an annulus of the seal 25 that is thinner than the remainder of the seal 25. The puncturable portion 27 is configured to be at least partially punctured and/or ruptured by one or more puncture elements 44 of the puncturing device 40'. When the puncturable portion 27 is at least partially punctured and/or ruptured by one or more puncture elements 44, product 310 may be released through neck 21 (e.g., via the punctured and/or ruptured portion of the seal 25) and thereby provided to the applicator 50.

FIGS. 15A and 15B provide perspective views of an example puncturing device 40' that may be used with the example capsule 20', in an example embodiment. The puncturing device 40' comprises a base element 46', one or more puncture elements 44, one or more flow channels 43, one or more holes 42', and one or more mating members 48. In an example embodiment, the one or more mating members 48 are configured to hold the puncturing device 40' about the neck 21 of the capsule 20'. For example, the one or more mating members 48 may hold, secure, couple, and/or the like the puncturing device 40' about the neck 21 of the capsule such that at least one of the one or more puncture elements 44 is aligned with the puncturable portion 27 of the seal 25. For example, when product applicator assembly 100''' is compressed along a dispensing axis 35 of the product applicator assembly 100''', the base element 46' of the puncturing device 40' may be pushed toward the neck 21 of the capsule 20' such that at least one of the puncture elements 44 may at least partially puncture, rupture, and/or the like the puncturable portion 27.

When the puncturable portion 27 is at least partially punctured, ruptured, and/or the like, the product 310 is released from the cup 28', flows through the one or more flow channels 43, flows through the one or more holes 42', and at least partially saturates the applicator 50. In an example embodiment, the at least partial puncturing, rupturing, and/or the like of the puncturable portion 27 may cause an audible "pop" sound or other audible indicator. For example, the thickness and/or material properties of the puncturable portion 27 and/or puncture elements 44 may be chosen such that puncturing of the puncturable portion 27 takes sufficient force to create an audible indicator that the seal 25 has been punctured. The audible indicator of the puncture may provide a consumer with an indication or notification that the product has been released from the capsule 20'.

FIG. 16 illustrates example processes and procedures for using a product applicator assembly 100. Starting at block 2, a consumer retrieves a product applicator assembly 100. For example, a consumer may open the packaging of a product applicator assembly 100 and remove the product applicator assembly 100 therefrom. At block 4, the consumer may compress the applicator 50 to selectively release and/or dispense the product 310 from the product reservoir (e.g., a capsule 20). For example, the consumer may hold the handle 10 and press the applicator 50 against a surface (e.g., surface 300) until the consumer hears an audible indicator that the product 310 has been released from the product reservoir (e.g., that the puncturing device 40 has punctured the capsule 20). For example, the consumer may hold the handle 10 and compress the applicator 50 along the dispensing axis by pressing the applicator 50 against a surface (e.g., surface 300) to cause the product 310 to be released and/or dispensed from the capsule 20. Once, the product 310 has been released from the product reservoir, the product may saturate, at least in part, the applicator 50. At block 6, the consumer may apply the product 310 to a surface 300. For example, the consumer may hold the handle 10 in their hand 305 and move and/or rub the product applicator assembly 100 against the surface 300 with the application surface 54 in contact with the surface 300. When the consumer is finished applying the product 310 to the surface 300 (e.g., finished cleaning and/or conditioning the surface 300), the consumer may place the product applicator assembly 100 in a waste receptacle.

Many modifications and other embodiments of the disclosure set forth herein will come to mind to one skilled in the art to which these disclosures pertain having the benefit of the teachings presented in the foregoing descriptions and the associated drawings. Therefore, it is to be understood that the disclosure is not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A product applicator assembly, the assembly comprising:
   - a handle comprising a handle form and a shell, wherein the shell fits over the handle form and the handle form comprises a handle recess defining a hollow interior;
   - an applicator; and
   - a product dispensing assembly disposed at least in part within the handle recess and storing a liquid product within a product container,
   - wherein:
     - the handle comprises a handle joining surface and the applicator comprises an applicator joining surface,
     - the handle joining surface is firmly secured to the applicator joining surface,
     - and
     - the product dispensing assembly is configured to selectively release at least a portion of the liquid product into the applicator.

2. The product applicator assembly of claim 1, wherein the liquid product is a thick liquid, or gel product.

3. The product applicator assembly of claim 1, wherein the product dispensing assembly comprises at least one puncture element, the at least one puncture element configured to facilitate rupturing at least a portion of the product container to release the at least a portion of the liquid product into the applicator.

4. The product applicator assembly of claim 3, wherein the product container comprises a sealed capsule, the capsule comprising a cup and a seal, and the at least one puncture element is configured to puncture the seal to release the at least a portion of the liquid product into the applicator.

5. The product applicator assembly of claim 4, wherein the seal is configured to provide an audible indicator when the seal is punctured.

6. The product applicator assembly of claim 1, wherein the applicator comprises an open-celled sponge.

7. The product applicator assembly of claim 1, wherein the handle comprises at least one of a closed-cell sponge, ethylene-vinyl acetate, blow molded plastic, and foam rubber.

8. The product applicator assembly of claim 1, wherein the liquid product is a cleaning solution or a conditioner.

9. A product applicator assembly, the assembly comprising:
   - a handle;
   - an applicator; and
   - a product dispensing assembly storing a liquid product within a product container,
   - wherein:

the handle comprises a handle joining surface and the applicator comprises an applicator joining surface, the handle joining surface is firmly secured to the applicator joining surface, the product dispensing assembly is disposed at least in part within the handle, and the product dispensing assembly comprises a puncturing device comprising a base and at least one puncture element extending from the base toward the product container, wherein the puncturing device further comprises a projection extending from the base and secured to the product container, and wherein the at least one puncture element is configured to facilitate rupturing at least a portion of the product container to release at least a portion of the liquid product into the applicator.

10. The product applicator assembly of claim 9, wherein the puncturing device includes one or more holes.

11. The product applicator assembly of claim 9, wherein the puncturing device comprises two or more puncture elements that are spaced apart.

12. The product applicator assembly of claim 9, wherein the puncturing device defines a flow channel extending through the base, the flow channel configured to direct the at least a portion of the liquid product to the applicator.

13. The product applicator assembly of claim 9, wherein the product container comprises a cup and a neck extending from the cup, wherein the puncturing device engages at least a portion of the neck.

14. The product applicator assembly of claim 9, wherein the product container comprises a sealed capsule, the sealed capsule comprising a cup and a seal, the cup having a lip about an opening of the cup, wherein outer dimensions of the base are substantially the same as dimensions of the lip.

15. A method of applying a product to a surface, the method comprising:

providing a product applicator assembly, the product applicator assembly including a handle and an applicator, the handle comprising a handle form and a shell, wherein the shell fits over the handle form and the handle form comprises a handle recess defining a hollow interior, the handle including a handle joining surface and the applicator including an applicator joining surface, the handle joining surface being firmly secured to the applicator joining surface, the product applicator assembly further including a product dispensing assembly disposed at least in part within the handle recess and storing a liquid product within a product container;

compressing the applicator, wherein compressing the applicator causes the product dispensing assembly to selectively release at least a portion of the liquid product into the applicator; and moving the product applicator assembly across the surface with an application surface of the applicator in contact with the surface.

16. The method of claim 15, wherein the product dispensing assembly further includes at least one puncture element positioned such that compressing the applicator causes the at least one puncture element to rupture the product container.

17. The method of claim 16, wherein the product container includes a sealed capsule, the capsule comprising a cup and a seal, wherein when the applicator is compressed, the at least one puncture element punctures the seal causing the at least a portion of the liquid product to release into the applicator.

18. A product applicator assembly, the assembly comprising:

a handle;

an applicator; and a product dispensing assembly storing a liquid product within a product container, the product container comprising a cup and a neck extending from the cup, wherein:

the handle comprises a handle joining surface and the applicator comprises an applicator joining surface, the handle joining surface is firmly secured to the applicator joining surface, the product dispensing assembly is disposed at least in part within the handle, and the product dispensing assembly comprises a puncturing device comprising a base and at least one puncture element extending from the base toward the product container, wherein the puncturing device engages at least a portion of the neck and the at least one puncture element is configured to facilitate rupturing at least a portion of the product container to release at least a portion of the liquid product into the applicator.

19. The product applicator assembly of claim 18, wherein the handle further comprises a handle form and a shell, wherein the handle form defines a handle recess.

20. The product applicator assembly of claim 19, wherein the product dispensing assembly is disposed at least in part within the handle recess and the shell fits over the handle form.

* * * * *